US010317086B2

(12) United States Patent
Acosta Herrero et al.

(10) Patent No.: US 10,317,086 B2
(45) Date of Patent: Jun. 11, 2019

(54) BURNER FOR A GAS-HEATED COOKING APPLIANCE

(71) Applicant: BSH Bosch und Siemens Hausgeräte GmbH, Munich (DE)

(72) Inventors: Luis Acosta Herrero, Maliaño (ES); Ainhoa De Carlos Negro, Maliaño (ES); Pedro Herrera Estrada, Santander (ES); Luis Antonio Palacios Valdueza, Astillero (ES); Emilio Placer Maruri, Liencres (ES); Sara Trigueros Preciado, Muriedas (ES)

(73) Assignee: BSH Hausgeräte GmbH, Munich (DE)

( * ) Notice: Subject to any disclaimer, the term of this patent is extended or adjusted under 35 U.S.C. 154(b) by 918 days.

(21) Appl. No.: 14/390,799

(22) PCT Filed: Apr. 10, 2013

(86) PCT No.: PCT/IB2013/052850
§ 371 (c)(1),
(2) Date: Oct. 6, 2014

(87) PCT Pub. No.: WO2013/156902
PCT Pub. Date: Oct. 24, 2013

(65) Prior Publication Data

US 2015/0090249 A1 Apr. 2, 2015

(30) Foreign Application Priority Data

Apr. 20, 2012 (DE) ..... 10 2012 206 507
Oct. 31, 2012 (ES) ..... 201231672

(51) Int. Cl.
*F24C 3/08* (2006.01)
*F23D 14/06* (2006.01)
*F24C 15/10* (2006.01)

(52) U.S. Cl.
CPC ..... *F24C 3/08* (2013.01); *F23D 14/06* (2013.01); *F24C 15/10* (2013.01)

(58) Field of Classification Search
None
See application file for complete search history.

(56) References Cited

U.S. PATENT DOCUMENTS 850,996 A * 4/1907 Cooley ..... F23D 14/48 261/75
959,057 A * 5/1910 Hanson ..... F23C 99/00 126/91 A (Continued)

FOREIGN PATENT DOCUMENTS

CN 201166364 Y 12/2008
EP 2072895 A1 6/2009

(Continued)

OTHER PUBLICATIONS

Report of Examination CN 201380020803.7 dated May 5, 2016.
International Search Report PCT/IB2013/052850 dated Nov. 20, 2013.

*Primary Examiner* — Avinash A Savani
*Assistant Examiner* — Martha M Becton
(74) *Attorney, Agent, or Firm* — Michael E. Tschupp; Andre Pallapies; Brandon G. Braun

(57) ABSTRACT

A burner for a gas-heated cooking appliance includes a pipe for mixing burnable gas with primary air, and a deflecting element which is arranged in an interior space which is bounded by the pipe. The pipe has one end which points toward a nozzle of the burner and another end which points toward a cover of the burner. The deflecting element is arranged in the interior space between a center of the pipe in respect of a longitudinal direction thereof and the one end of the pipe.

27 Claims, 5 Drawing Sheets

(56) References Cited

U.S. PATENT DOCUMENTS 1,109,272 A * 9/1914 Wierum ..... B05B 7/10 239/399
1,305,436 A * 6/1919 Blanchard ..... F23C 99/00 431/171
1,329,559 A * 2/1920 Tesla ..... F15C 1/00 137/842
1,354,295 A * 9/1920 Hamilton ..... F23D 14/06 239/432
1,368,120 A * 2/1921 Cole ..... F23D 14/06 239/553.3
1,381,092 A * 6/1921 Kolva ..... F23D 14/70 431/356
1,557,261 A * 10/1925 McCarthy ..... F02M 29/02 48/189.5
1,678,225 A * 7/1928 Kincade ..... B01F 5/0415 196/46
1,689,446 A * 10/1928 Miller ..... F02M 1/00 138/37
1,722,066 A * 7/1929 Tabler ..... F23D 14/70 239/431
1,817,066 A * 8/1931 Crow ..... 431/278
1,855,275 A * 4/1932 Bailey ..... F02M 1/00 48/189.4
1,921,282 A * 8/1933 Cook ..... F02M 1/00 138/37
2,528,094 A * 10/1950 Walker ..... B01F 5/0057 210/207
2,669,946 A * 2/1954 Peyton ..... A23G 9/282 366/173.2
2,754,895 A * 7/1956 Hershey ..... F23D 14/70 431/349
3,233,654 A * 2/1966 Anderson ..... F23D 14/10 159/43.1
3,289,731 A * 12/1966 Geber ..... F23D 14/06 126/39 R
3,297,305 A * 1/1967 Walden ..... B01F 5/0451 169/15
3,844,707 A * 10/1974 Wormser ..... F23D 14/38 239/399
3,846,064 A * 11/1974 Katchka ..... F23D 14/70 431/171
4,255,121 A * 3/1981 Sugimoto ..... F23C 99/00 239/135
4,255,124 A * 3/1981 Baranowski, Jr. .... B01F 5/0617 239/466
4,629,415 A * 12/1986 DeWerth ..... F23D 14/84 126/39 E
4,639,215 A * 1/1987 Armstrong ..... F23D 14/38 239/399
4,718,393 A * 1/1988 Bakish ..... B01F 5/0617 123/545
4,846,670 A * 7/1989 Pearl, II ..... F23D 14/52 431/346
4,872,833 A * 10/1989 Kramer ..... B01F 5/0415 431/346
4,886,447 A * 12/1989 Goss ..... F23D 14/38 239/432
5,163,830 A * 11/1992 Pfefferkorn ..... B01F 5/0413 366/163.2
5,427,181 A * 6/1995 Laskaris ..... A62C 5/02 169/14
5,649,822 A * 7/1997 Gertler ..... F23D 14/06 126/39 E
6,000,934 A * 12/1999 Shavers ..... F23D 14/10 239/432
6,042,263 A * 3/2000 Mentzer ..... B01F 5/061 138/44
6,079,402 A * 6/2000 Gort ..... F24C 3/085 126/39 B
6,190,163 B1 * 2/2001 Maricic ..... F23D 14/04 239/556
6,203,188 B1 * 3/2001 Maurer ..... B01F 5/0619 366/336
6,394,644 B1 * 5/2002 Streiff ..... B01F 5/0613 366/337
6,736,376 B1 * 5/2004 DeLisle ..... F02B 19/14 261/79.1
6,752,124 B1 * 6/2004 Chang ..... F02B 31/04 123/306
7,172,413 B2 * 2/2007 Han ..... D06F 58/263 239/504
8,033,714 B2 * 10/2011 Nishioka ..... B01D 53/8631 137/888
8,714,967 B2 * 5/2014 Garrison ..... F23C 99/001 210/222
8,755,682 B2 * 6/2014 Shorr ..... F24H 9/0015 392/465
9,115,892 B2 * 8/2015 Bettinzoli ..... F23D 14/065
9,217,572 B2 * 12/2015 Park ..... F24C 3/085
9,612,012 B2 * 4/2017 Yang ..... F23D 14/28
9,869,471 B2 * 1/2018 Yang ..... F23D 14/28
2003/0024525 A1 * 2/2003 Jennings ..... F23D 14/045 126/39 R
2004/0048216 A1 * 3/2004 Brown ..... F23D 14/06 431/354
2004/0223408 A1 * 11/2004 Mathys ..... B01F 5/0473 366/337
2006/0000467 A1 * 1/2006 Hibshman, II ..... F23D 14/06 126/39 E
2006/0245296 A1 * 11/2006 Nishioka ..... B01D 53/8631 366/174.1
2009/0266077 A1 * 10/2009 Syed ..... F23C 7/002 60/722
2010/0000515 A1 * 1/2010 Tomaselli ..... F23D 14/06 126/39 E
2010/0050648 A1 * 3/2010 Miura ..... F23D 14/70 60/748
2010/0206293 A1 * 8/2010 Padgett ..... F23D 14/06 126/39 E
2010/0212322 A1 * 8/2010 York ..... F23R 3/286 60/738
2010/0282238 A1 * 11/2010 He ..... F24C 3/085 126/39 E
2010/0310998 A1 * 12/2010 Raleigh ..... F23D 14/58 431/8
2011/0048400 A1 * 3/2011 Biagioli ..... F23D 14/06 126/39 E
2011/0120444 A1 * 5/2011 Ryu ..... F23D 14/06 126/39 E
2011/0207059 A1 * 8/2011 Garrison ..... F23C 99/001 431/2
2012/0090595 A1 * 4/2012 Shaffer ..... F23D 14/06 126/39 E
2012/0308943 A1 * 12/2012 Ng ..... F23D 14/02 431/11
2013/0199513 A1 * 8/2013 Bettinzoli ..... F23D 14/065 126/39 E
2013/0233296 A1 * 9/2013 Cadima ..... F23D 14/06 126/39 E
2013/0306055 A1 * 11/2013 Cadima ..... F24C 3/085 126/39 E
2014/0190468 A1 * 7/2014 Park ..... F24C 3/085 126/39 E
2014/0305424 A1 * 10/2014 Braden ..... F24C 3/085 126/39 E
2015/0034070 A1 * 2/2015 Fogolin ..... F23D 14/06 126/39 E
2015/0219340 A1 * 8/2015 Cadima ..... F23D 14/06 126/39 E
2015/0308677 A1 * 10/2015 Brouard ..... F23D 14/085 126/39 E
2015/0345800 A1 * 12/2015 Cabrera Botello ..... F23D 14/06 126/39 E
2016/0018131 A1 * 1/2016 Meso ..... F23D 14/70 126/90 R
2016/0201902 A1 * 7/2016 Cadima ..... F24C 3/085 126/39 E

(56) References Cited

U.S. PATENT DOCUMENTS

| | | | | |
|---|---|---|---|---|
| 2016/0215975 | A1* | 7/2016 | Gutierrez Humara | F23K 5/002 |
| 2017/0003033 | A1* | 1/2017 | Lona Santoyo | F23D 14/02 |
| 2017/0108215 | A1* | 4/2017 | Yang | F23D 14/06 |

FOREIGN PATENT DOCUMENTS

| | | | |
|---|---|---|---|
| EP | 2597370 | * | 5/2013 |
| GB | 1445499 | | 8/1976 |
| GB | 2219071 A | * | 11/1989 |
| WO | 8300913 | | 3/1983 |
| WO | 2006077058 A1 | | 7/2006 |

* cited by examiner

BURNER FOR A GAS-HEATED COOKING APPLIANCE

BACKGROUND OF THE INVENTION

The present invention relates a burner for a gas-heated cooking appliance.

A burner for a gas-heated cooking appliance is known for example from WO 2006/077058 A1. The burner comprises a pipe for mixing burnable gas with primary air.

BRIEF SUMMARY OF THE INVENTION

The object of the present invention is to provide an improved burner for a gas-heated cooking appliance, which in particular is distinguished by high efficiency.

To achieve this object a burner is proposed for a gas-heated cooking appliance with a pipe for mixing burnable gas with primary air and a deflecting element. The deflecting element is arranged in the interior space bounded by the pipe.

Thanks to the deflecting element the burnable gas is mixed even better with the primary air. As a result, the burnable gas combusts even better at flame outlets of the burner, so that the energy efficiency of the burner is increased. "Deflecting element" here means an element which is designed to deflect the burnable gas, the primary air or both. The deflection here takes place in particular in respect of the main inflow direction of the burnable gas, of the primary air or of the mixture thereof. The main inflow direction may correspond to the longitudinal direction of the pipe. "Longitudinal direction" of the pipe means the direction of the pipe in which it has an essentially constant cross-section.

According to one embodiment one end of the pipe points to a nozzle and the other end points to a cover. The deflecting element can be arranged between and including a center of the pipe in respect of a longitudinal direction thereof and the one end. Experiment has shown that such an arrangement of the deflecting element surprisingly results in particularly large increases in the energy efficiency of the burner. "Including a center" means that the deflecting element can also be arranged precisely in the center.

According to another embodiment the deflecting element is cruciform in design. It has been found that with a cruciform element particularly large increases in the energy efficiency of the burner are possible.

According to another embodiment the deflecting element has at least one piece of wire. Such a deflecting element is simple to manufacture.

According to another embodiment the piece of wire has a diameter of between 0 and 3 mm, preferably between 1 and 2 mm and further preferably between 1.3 and 1.7 mm. Specifically, particularly large increases in the energy efficiency of the burner can be achieved for the values between 1.3 and 1.7 mm.

According to another embodiment the piece of wire is made of metal or plastic. The piece of wire can be formed integrally with the pipe. "Integrally" means that the pipe and the piece of wire are made of one and the same material and are formed in one piece. On the other hand the piece of wire may also be attached in the pipe by form fit, by force fit or by bonding.

According to another embodiment the pipe has an inner wall, to which the piece of wire is connected at its respective ends. This means the piece of wire can easily be attached in the pipe.

According to another embodiment the inner wall has a diameter of between 5 and 20 mm, preferably between 8 and 14 mm and further preferably between 10 and 12 mm. Surprisingly, it was possible to achieve particularly large increases in energy efficiency for a diameter of the inner wall between 10 and 12 mm in conjunction with a piece of wire with a diameter of between 1.3 and 1.7 mm.

According to another embodiment the deflecting element has two pieces of wire, which are each connected to one another in the center. This means the aforementioned cruciform shape can easily be manufactured. The two pieces of wire can be formed integrally with one another. Furthermore the two pieces of wire can be connected to one another for example by form fit. More than two pieces of wire can also be provided.

According to another embodiment the nozzle is arranged at a distance from the one end of the pipe. This means primary air can be sucked into the burnable gas flow exiting from the nozzle and into the one end of the pipe.

According to another embodiment the other end of the pipe opens out into a space underneath the cover, which is radially connected via flame outlets to the surrounding area. When the burner is installed in the gas-heated cooking appliance the pipe extends in a vertical direction. Underneath the cover the gas mixture exiting from the pipe into the space is deflected in a horizontal direction.

According to another embodiment the nozzle is a component of a lower part. The pipe can be a component of an upper part. Together the lower part and the upper part form a base. The cover can be placed on the upper part. The cover can define flame outlets with the upper part.

According to another embodiment the lower part has a chamber open on one side, into which the pipe extends. The chamber is in turn connected to openings to feed the primary air out of the surrounding area into the chamber.

According to another embodiment the space is formed underneath the cover between the upper part and the cover.

Furthermore a gas-heated cooking appliance, in particular a gas hob, is proposed with the inventive burner.

The burner is designed for use in the home. This means the gas-heated cooking appliance is designed as a household appliance.

Other possible implementations of the invention also comprise not explicitly cited combinations of features or embodiments of the burner or of the cooking appliance described previously or below in respect of the exemplary embodiments. In this case the person skilled in the art will also add or modify individual aspects as improvements or additions to the respective basic form of the invention.

BRIEF DESCRIPTION OF THE DRAWINGS

Other advantageous configurations and aspects of the invention are the subject matter of the subclaims and of the exemplary embodiments of the invention described in the following. The invention is explained in greater detail below on the basis of preferred embodiments with reference to the appended figures, in which:

DETAILED DESCRIPTION OF EXEMPLARY EMBODIMENTS OF THE PRESENT INVENTION

Figure 1:
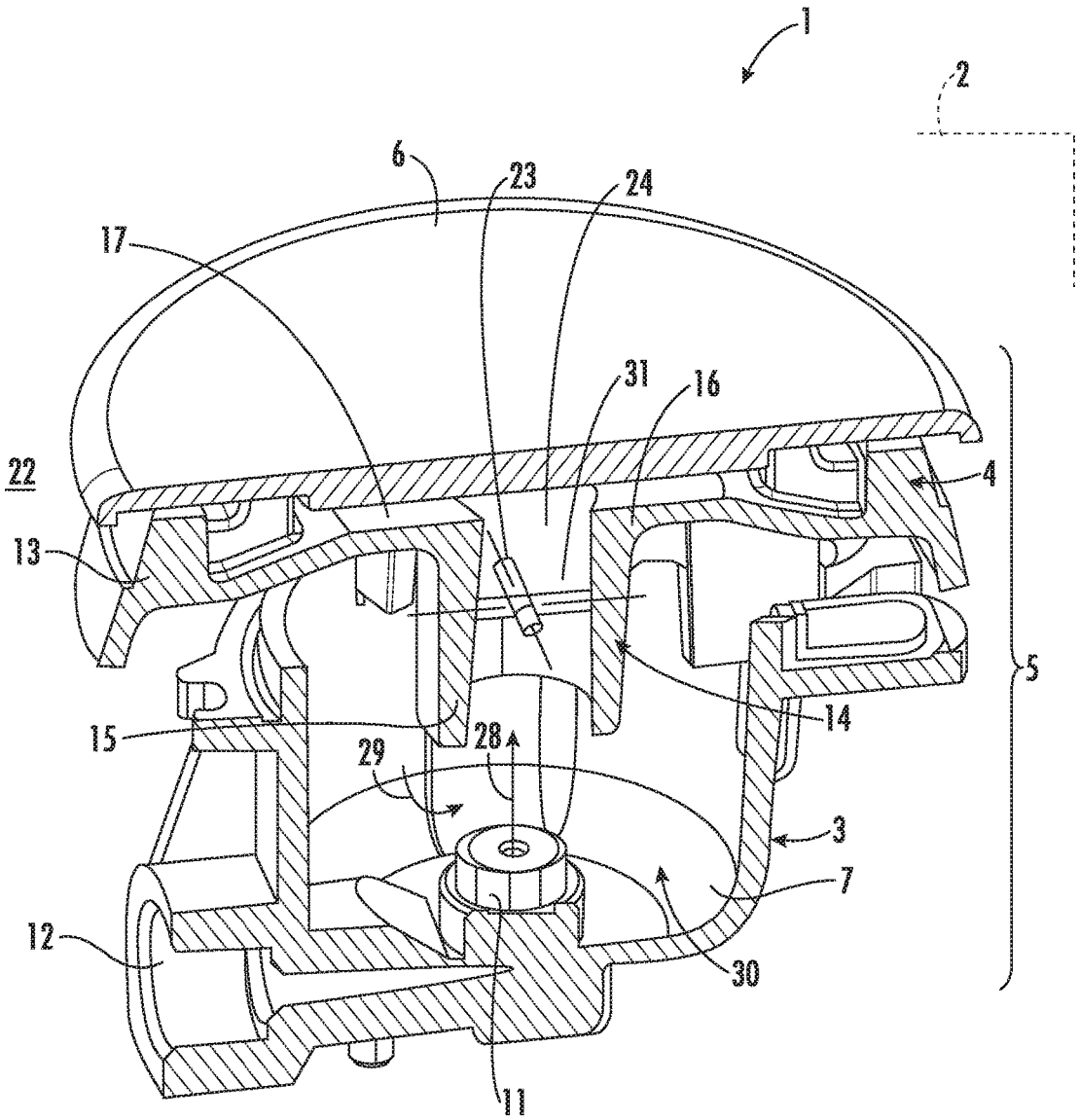
FIG. 1: shows a perspective view of a section through a burner according to one embodiment.

In the figures the same reference characters refer to identical or functionally identical elements, unless indicated otherwise.

FIG. 1 shows a perspective view of a section through a burner 1 according to one embodiment.

The burner 1 is for example a component of a gas-heated cooking appliance in the form of a schematically indicated gas hob 2. The gas hob 2 is designed for use in the home.

The burner 1 comprises a lower part 3 and an upper part 4. The lower and upper part 3, 4 together form a base 5 of the burner 1. A cover 6 is placed on the upper part 4.

The lower part 3 comprises a chamber 7, on the floor of which a nozzle 11 is arranged. The nozzle 11 is connected via a gas connection 12 of the lower part 3 to a gas supply line (not shown).

The upper part 4 comprises a plate 13, from which a pipe 14 projects downward. One end 15 of the pipe 14 is directed toward the nozzle 11 and is designed to be open in respect thereof. At its other end 16 the pipe 14 is integrally formed with the plate 13 and has an opening to a defined space 17 between the cover 6 and the plate 13.

Figure 2:
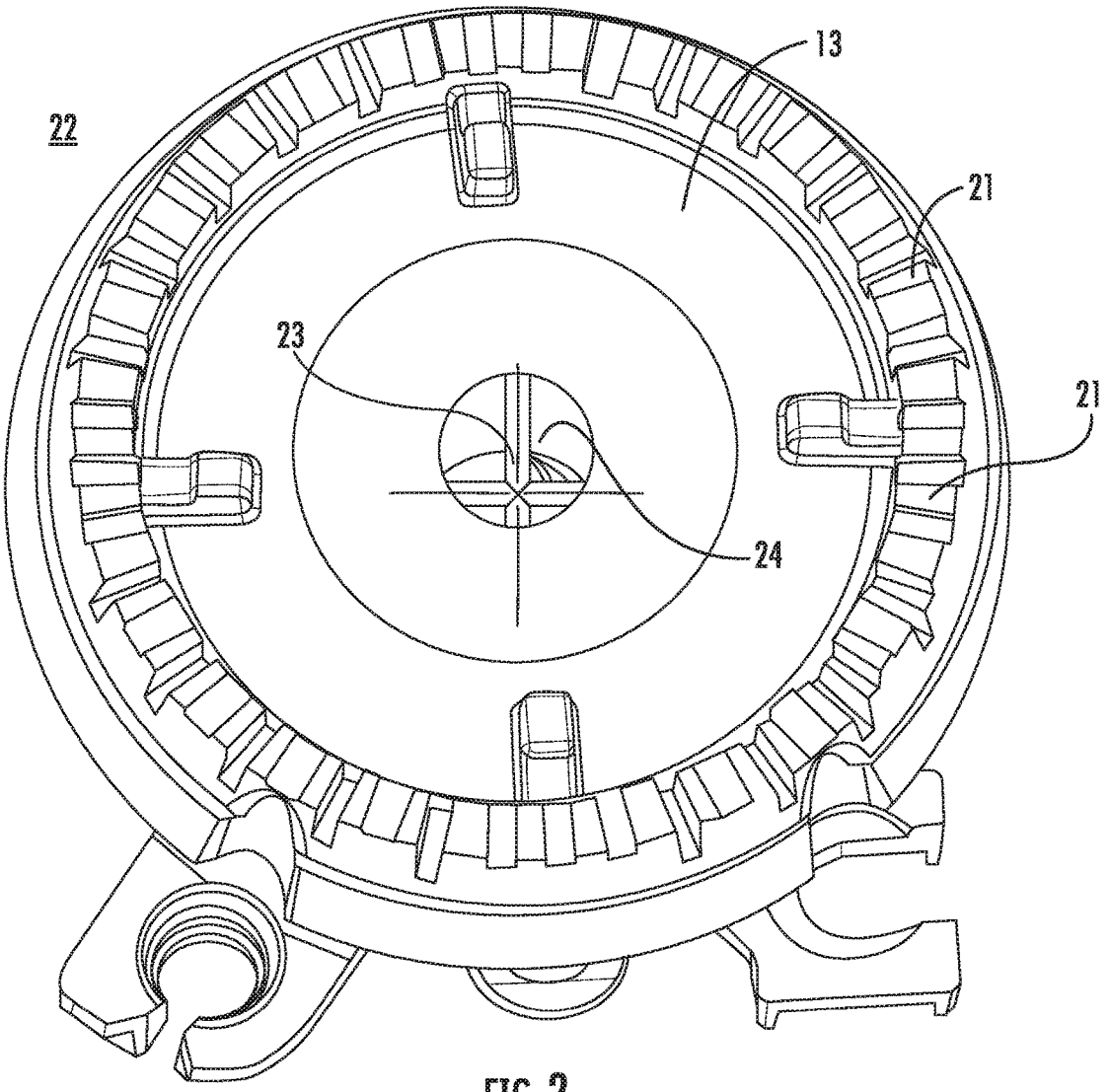
FIG. 2: shows a perspective view of the burner from FIG. 1, but with the cover removed.

FIG. 2 shows a perspective view of the burner from FIG. 1, but with the cover 6 removed.

In FIG. 2 it can be seen that the plate 13 has flame outlets 21 on its circumference, which entirely define it together with the cover 6. The flame outlets 21 connect the space 17 (see FIG. 1) to the surrounding area 22.

In FIGS. 1 and 2 a deflecting element 23 can be seen in each case, which is arranged in the interior space 24 bounded by the pipe 14. The deflecting element 23 is for example designed in the form of a wire cross.

Figure 3:
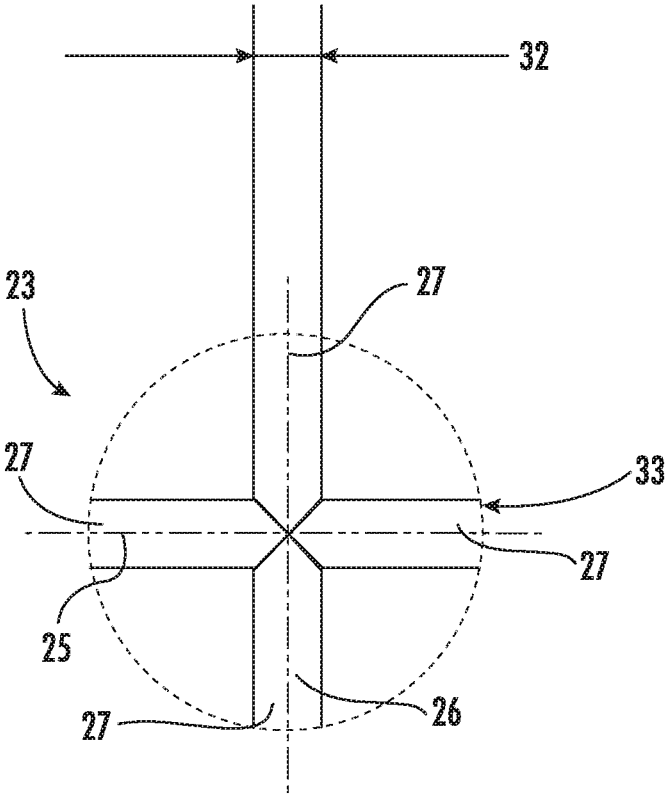
FIG. 3: shows a plan view of a deflecting element of the burner from FIG. 1.

FIG. 3 shows the deflecting element 23 from FIGS. 1 and 2 in a plan view.

The deflecting element 23 comprises two pieces of wire 25, 26 made of metal, which are connected to one another in the center. In particular the pieces of wire 25, 26 can be formed integrally. The pieces of wire 25, 26 can be arranged at an angle of 90° to one another. Further, the pieces of wire 25, 26 are firmly connected at their respective ends 27 to the inner wall 31 of the pipe 14. The deflecting element 23 can also be formed integrally with the inner wall 31. A respective piece of wire 25, 26 has a diameter 32 of for example 1.5 mm. The diameter 33 of the inner wall 31 is for example 11.4 mm. This diameter 33 corresponds to the external diameter of the deflecting element 23.

Figure 4:
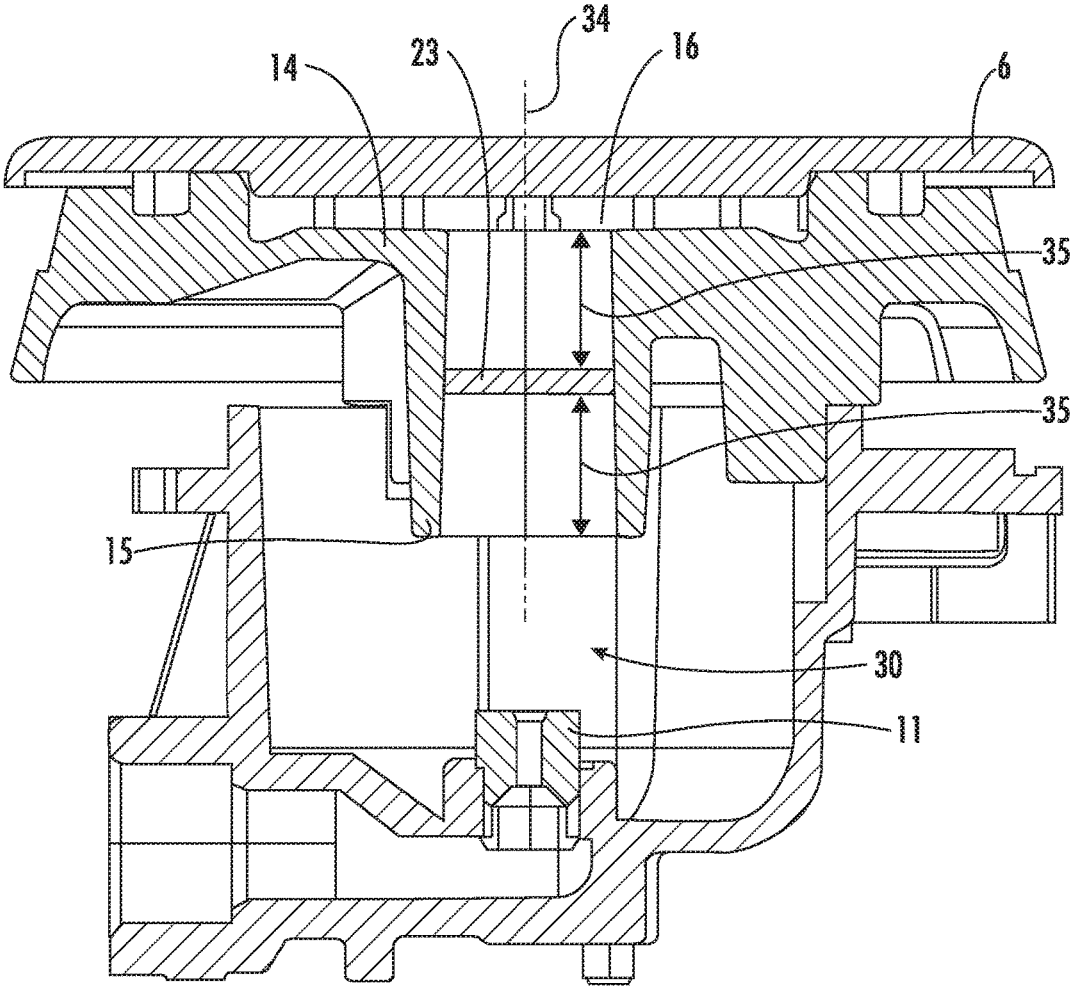
FIG. 4: shows a plan view of the section from FIG. 1.

FIG. 4 shows the section from FIG. 1 in a plan view.

On the basis of FIG. 4 the precise arrangement of the deflecting element 23 in respect of the longitudinal axis 34 of the pipe 14 can in particular be seen. According to the exemplary embodiment the deflecting element 23 is arranged in the center between the ends 15, 16 of the pipe 14. The correspondingly identical spacings of the deflecting element 23 from the respective ends 15, 16 are designated in FIG. 4 by 35. However, the deflecting element 23 could also be arranged closed to the end 15. The pipe 14 can, as shown in FIG. 4, have a cross-section which tapers in the direction of the cover 6. For example, the interior diameter of the pipe 14 in the region of the end 15 can be between 11.8 and 12.2 mm. In the region of the end 16, in contrast, the internal diameter of the pipe 14 can now be between 10.8 and 11.2 mm.

Burnable gas 28 flowing out of the nozzle 11 in the longitudinal direction 34 of the pipe 14 (see FIG. 1) is mixed with primary air 29 in the pipe 14. The primary air 29 in this case enters the end 15 of the pipe 14 via a radial gap 30 between the end 15 and the nozzle 11. The mixing of the burnable gas 28 with the primary air 29 is considerably improved by the deflecting element 23.

Figure 5:
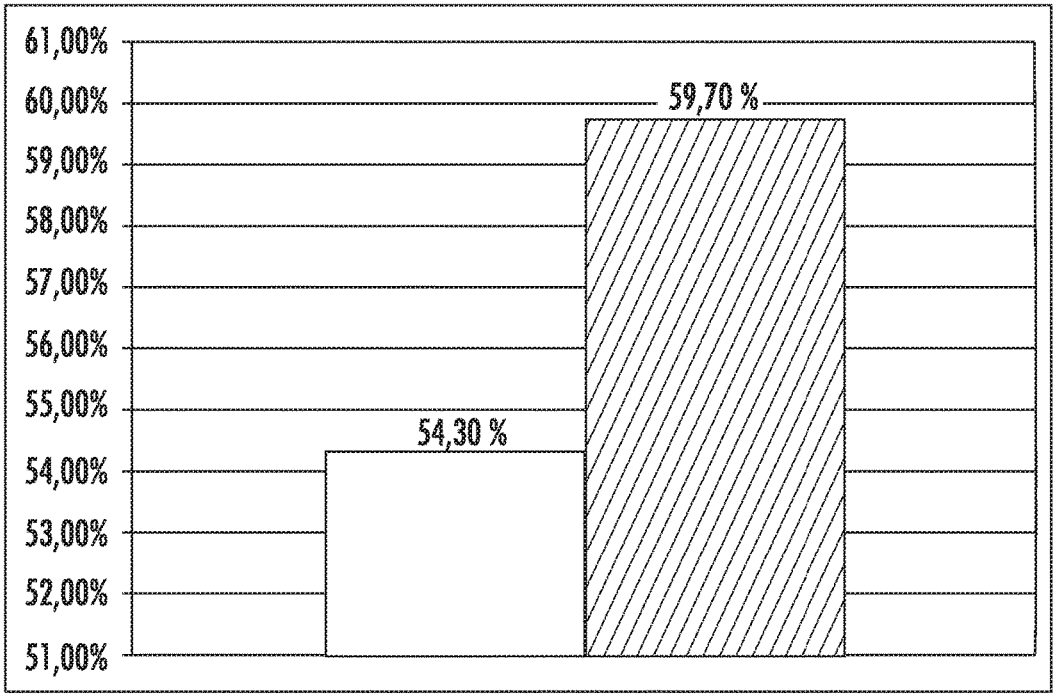
FIG. 5: shows a diagram on energy efficiency.

FIG. 5 shows a diagram on energy efficiency.

The white column shows the measured energy efficiency for the burner 1 according to FIGS. 1-4 without the deflecting element 23. The energy efficiency was 54.3%. In another experiment the energy efficiency of the burner 1 was determined with the deflecting element 23 (see the hatched column). Surprisingly, the energy efficiency was 59.7%, in other words 5.4% above the embodiment without a deflecting element 23.

Although the invention has here been described on the basis of exemplary embodiments, it can be variably modified.

The invention claimed is:

1. A burner for a gas-heated cooking appliance, comprising:

a base comprising a lower part and an upper part;

a cover configured to be placed on the upper part;

the lower part comprising a chamber, the chamber having a floor;

a nozzle arranged perpendicularly through the floor and configured to supply gas from a gas supply line;

the upper part further comprising a plate that is generally parallel to the cover and forms a space between the cover and said plate, the plate having flame outlets around the plate's circumference, the plate further comprising an integral pipe that projects downward towards, and coaxial with, the nozzle;

a radial gap for primary air entry formed within the lower part such that primary air may enter under the plate;

the pipe forming a flow path for mixing gas with the primary air; and a deflecting element comprising at least one piece of wire, the deflecting element suspended within the pipe perpendicular to the flow path formed by the pipe so as to provide further mixing of gas and primary air so it can be supplied to the flame outlets via the space between the cover and plate.

2. The burner of claim 1, further comprising said pipe having one end which points toward the nozzle and another end which points toward the cover, said deflecting element being arranged between a center of the pipe in respect of a longitudinal direction thereof and the one end of the pipe.

3. The burner of claim 2, wherein the nozzle is arranged at a distance from the one end of the pipe.

4. The burner of claim 1, wherein the deflecting element is designed to be cruciform.

5. The burner of claim 1, wherein the piece of wire has a diameter of between 0 and 3 mm.

6. The burner of claim 1, wherein the piece of wire has a diameter of between 1 and 2 mm.

7. The burner of claim 1, wherein the piece of wire has a diameter of between 1.3 and 1.7 mm.

8. The burner of claim 1, wherein the piece of wire is made of metal or plastic.

9. The burner of claim 1, wherein the pipe has an inner wall, to which ends of the at least one piece of wire are connected.

10. The burner of claim 9, wherein the inner wall has a diameter of between 5 and 20 mm.

11. The burner of claim 9, wherein the inner wall has a diameter of between 8 and 14 mm.

12. The burner of claim 9, wherein the inner wall has a diameter of between 10 and 12 mm.

13. The burner of claim 1, wherein the deflecting element has two pieces of wire, which are connected to one another centrally.

14. The burner of claim 1, wherein the lower part has a chamber open on one side, said pipe being sized to extend into the chamber.

15. A gas-heated cooking appliance having a burner, said burner comprising:

a base comprising a lower part and an upper part;

a cover configured to be placed on the upper part;

the lowest part comprising a chamber, the chamber having a floor;

a nozzle arranged perpendicularly through the floor and configured to supply gas from a gas supply line;

the upper part further comprising a plate that is generally parallel to the cover and forms a space between the cover and said plate, the plate having flame outlets around the plate's circumference, the plate further comprising an integral pipe that projects downward towards, and coaxial with, the nozzle;

a radial gap for primary air entry formed within the lower part such that primary air may enter under the plate;

the pipe forming a flow path for mixing gas with the primary air;

and a deflecting element comprising at least one piece of wire, the deflecting element suspended within the pipe perpendicular to the flow path formed by the pipe so as to provide further mixing of gas and primary air so it can be supplied to the flame outlets via the space between the cover and plate.

16. The gas-heated cooking appliance of claim 15 constructed in the form of a gas hob.

17. The gas-heated cooking appliance of claim 15, further comprising said pipe having one end which points toward the nozzle and another end which points toward the cover, said deflecting element being arranged between a center of the pipe in respect of a longitudinal direction thereof and the one end of the pipe.

18. The gas-heated cooking appliance of claim 15, wherein the deflecting element is designed to be cruciform.

19. The gas-heated cooking appliance of claim 15, wherein the piece of wire has a diameter of between 0 and 3 mm.

20. The gas-heated cooking appliance of claim 15, wherein the piece of wire has a diameter of between 1 and 2 mm.

21. The gas-heated cooking appliance of claim 15, wherein the piece of wire has a diameter of between 1.3 and 1.7 mm.

22. The gas-heated cooking appliance of claim 15, wherein the piece of wire is made of metal or plastic.

23. The gas-heated cooking appliance of claim 15, wherein the pipe has an inner wall, to which ends of the at least one piece of wire are connected.

24. The gas-heated cooking appliance of claim 23, wherein the inner wall has a diameter of between 5 and 20 mm.

25. The gas-heated cooking appliance of claim 23, wherein the inner wall has a diameter of between 8 and 14 mm.

26. The gas-heated cooking appliance of claim 23, wherein the inner wall has a diameter of between 10 and 12 mm.

27. The gas-heated cooking appliance of claim 15, wherein the deflecting element has two pieces of wire, which are connected to one another centrally.

* * * * *